US011130105B2

(12) United States Patent
Drake et al.

(10) Patent No.: US 11,130,105 B2
(45) Date of Patent: Sep. 28, 2021

(54) THERMAL VALVE

(71) Applicant: ECOLAB USA INC, Saint Paul, MN (US)

(72) Inventors: Ryan Joseph Drake, Saint Paul, MN (US); Andrew Max Schultz, Saint Paul, MN (US); Jessica Roseanne Tumini, Saint Paul, MN (US); Kevin Andrew Wuebben, Saint Paul, MN (US); Jeffrey Alan Blansit, Saint Paul, MN (US); Ariel Chatman Kleczewski, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 146 days.

(21) Appl. No.: 16/129,514

(22) Filed: Sep. 12, 2018

(65) Prior Publication Data

US 2019/0076804 A1 Mar. 14, 2019

Related U.S. Application Data

(62) Division of application No. 14/182,346, filed on Feb. 18, 2014, now Pat. No. 10,099,188.

(Continued)

(51) Int. Cl.

*B01F 15/00* (2006.01)
*A47L 15/44* (2006.01)

(Continued)

(52) U.S. Cl.

CPC .... *B01F 15/00175* (2013.01); *A47L 15/4436* (2013.01); *B01F 1/0033* (2013.01); *B01F 15/00344* (2013.01); *B01F 15/0261* (2013.01)

(58) Field of Classification Search

CPC ..... B01F 15/00175

(Continued)

(56) References Cited

U.S. PATENT DOCUMENTS 2,115,501 A * 4/1938 Vernet ..... G01K 5/44 60/527
2,381,146 A * 8/1945 Von Wangenheim ..... G05D 23/1393 236/12.12

(Continued)

FOREIGN PATENT DOCUMENTS

CN 101018600 A 8/2007
JP 62176575 U1 11/1987

(Continued)

OTHER PUBLICATIONS

Series MMV Thermostatic Mixing Valves (2010).*

(Continued)

*Primary Examiner* — David L Sorkin
(74) *Attorney, Agent, or Firm* — McKee, Voorhees & Sease, PLC

(57) ABSTRACT

A method and apparatus for obtaining a solution from a solid product in contact with a liquid is provided. A solid product is housed within a dispenser. A liquid is introduced into contact with the solid product. The solution formed between the solid product and the liquid is collected, and a makeup liquid can be added thereto to further dilute or control the concentration of the formed solution. The amount of makeup liquid added to the solution can be controlled based on the temperature of the liquid to provide an automatic, continuously variable amount of liquid added to the solution. In addition, a method of providing a pressure independent control of the makeup liquid is also provided.

17 Claims, 10 Drawing Sheets

Related U.S. Application Data

(60) Provisional application No. 61/766,769, filed on Feb. 20, 2013.

(51) Int. Cl.
*B01F 15/02* (2006.01)
*B01F 1/00* (2006.01)

(58) Field of Classification Search
USPC ..... 366/152.1, 182.4; 60/527
See application file for complete search history.

(56) References Cited

U.S. PATENT DOCUMENTS

| | | | | |
|---|---|---|---|---|
| 2,442,886 | A * | 6/1948 | Bowen | G05D 23/1393 251/129.03 |
| 5,342,587 | A | 8/1994 | Laughlin et al. | |
| 5,494,644 | A | 2/1996 | Thomas et al. | |
| 6,495,374 | B1 * | 12/2002 | Mougin | G01N 1/10 436/180 |
| 7,708,023 | B2 | 5/2010 | Thomas et al. | |
| 8,993,137 | B2 | 3/2015 | Norden et al. | |
| 2006/0083668 | A1 | 4/2006 | Thomas et al. | |
| 2006/0083669 | A1 | 4/2006 | Thomas et al. | |
| 2006/0157575 | A1 | 7/2006 | Lockhart | |
| 2007/0253876 | A1 * | 11/2007 | Limback | B01F 5/0413 422/266 |
| 2010/0030390 | A1 | 2/2010 | Yamaguchi et al. | |
| 2013/0200063 | A1 | 8/2013 | Cooke et al. | |
| 2013/0306028 | A1 | 11/2013 | Monsallier et al. | |

FOREIGN PATENT DOCUMENTS

| | | | |
|---|---|---|---|
| JP | 2000317299 | A | 11/2000 |
| JP | 2008516755 | A | 5/2008 |
| JP | 2009535195 | A | 10/2009 |

OTHER PUBLICATIONS

Sinex, Scott. Developing a Mathematical Model for a Burning Candle. 2010. Department of Natural Sciences and Engineering, Prince George's Community College. pp. 1-8, <http://academic.pgcc.edu/-ssinex/excelets/, retrieved Nov. 1, 2017.

Ecolab USA Inc., PCT/US2014/016982 filed Feb. 18, 2014, "The International Search Report and the Written Opinion of the International Searching Authority, or the Declaration", dated Jul. 4, 2014.

* cited by examiner

THERMAL VALVE

CROSS-REFERENCE TO RELATED APPLICATIONS

This application is a divisional application of U.S. Ser. No. 14/182,346, filed on Feb. 18, 2014, which claims priority under 35 U.S.C. § 119 to provisional application Ser. No. 61/766,769, filed Feb. 20, 2013. The entire contents of all priority documents are herein incorporated by reference in their entirety, including without limitation, the specification, claims, and abstract, as well as any figures, tables, appendices, or drawings thereof.

FIELD OF THE INVENTION

The present invention relates generally to the formation of a solution between a solid product chemistry and a fluid in contact with the chemistry. More particularly, but not exclusively, the invention relates to a method and apparatus for adjusting an amount of make-up fluid added to a collected amount of solution based upon the temperature of the fluid in contact with the solid product chemistry.

BACKGROUND OF THE INVENTION

Dissolution parameters of a solid product into a liquid solution, such as a liquid detergent used for cleaning and sanitizing, change based on the operating parameters of and inputs to the dissolution process. Spraying liquid onto a solid product to dissolve it into a liquid solution is one technique. With this technique, the operating parameters change in part based on characteristics within the dispenser, such as the distance between the solid product and the spray nozzle and the change in the pressure and temperature of the liquid being sprayed onto the solid product. Changes in a nozzle's flow rate, spray pattern, spray angle, and nozzle flow can also affect operating parameters, thereby affecting the chemistry, effectiveness, and efficiency of the concentration of the resulting liquid solution. In addition, dissolution of a solid product by spraying generally requires additional space within the dispenser for the nozzles spray pattern to develop and the basin to collect the dissolved product, which results in a larger dispenser.

Furthermore, varying characteristics of the liquid, such as temperature and pressure, may affect the concentration of the formed solution in a collection zone. If the temperature of the liquid rises, it has been shown that the higher temperature liquid will erode more of the solid product chemistry, which will result in a higher concentration level for the solution. This can be remedied by adding an additional liquid amount, or make-up liquid, to the formed solution in the collection zone. However, it can be difficult to correctly counteract the higher temperature liquid with an appropriate amount of liquid.

The pressure of the liquid can also cause problems for a dispensing system trying to obtain and maintain a solution within an acceptable concentration range. The pressure of the make-up liquid can cause more liquid to be introduced to the solution in the collection zone than is needed, which could reduce the concentration. The reduction in concentration could affect the sanitizing and other cleaning characteristics of the solution formed between the liquid and the solid product chemistry.

Therefore, there is a need in the art for a method and apparatus for continuously adjusting the amount of make-up liquid added to the formed solution in the collection zone by taking known relationships between the temperature of the liquid and the erosion rate of the solid product chemistry, and providing a method and apparatus that will continuously and variably adjust the amount of make-up liquid added to the solution in the collection zone based upon this known relationship. There is also a need in the art for a way to control the concentration of a solution independent of the pressure of the liquid introduced to the solution.

SUMMARY OF THE INVENTION

Therefore, it is principal object, feature, and/or advantage of the present invention to provide an apparatus that overcomes the deficiencies in the art.

It is another object, feature, and/or advantage of the present invention to provide a method and apparatus for obtaining and maintaining a concentration of a solution produced by a liquid in contact with a solid product chemistry.

It is yet another object, feature, and/or advantage of the present invention to provide a method and apparatus that allows for automatic, continuously adjustable amounts of diluting liquid to be added to a solution based upon the temperature of a liquid.

It is still another object, feature, and/or advantage of the present invention to provide a method and apparatus that adjusts the amount of diluting liquid added to a solution independent of the pressure of the liquid.

It is a further object, feature, and/or advantage of the present invention to provide a dispenser to consistently produce a steady concentration of a solution.

It is still a further object, feature, and/or advantage of the present invention to provide a thermal valve assembly for a dispenser to mitigate temperature and pressure effects on a dispensing system.

It is yet a further object, feature, and/or advantage of the present invention to provide a thermal valve assembly that will provide an unlimited, variable amount of liquid to be introduced to the solution.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, a method of forming a solution from a concentrated product chemistry and a liquid having a concentration is provided. The method includes introducing a liquid to contact a concentrated product chemistry to form the solution, collecting the solution, introducing diluting liquid to the collected solution through a thermal valve assembly to obtain and maintain the concentration of the solution based upon the temperature of the liquid, and adjusting the amount of diluting liquid introduced to the collected solution based upon a change in the temperature of the liquid.

The amount of diluting liquid introduced can be adjusted based upon the temperature of the liquid. A thermal valve assembly can be incorporated, which will provide a continuously variable amount of liquid that is adjusted automatically to account for a change in the temperature of the liquid. Thus, more or less diluting liquid can be added based upon a change in the temperature of the liquid.

According to another aspect of the invention, a dispenser for obtaining a solution from a concentrated product chemistry and a liquid is provided. The dispenser includes a housing, a cavity at least partially within the housing for holding the concentrated product chemistry, a liquid source for providing the liquid to contact the concentrated product chemistry to form the solution, a collection zone operatively connected to the housing to collect the formed solution, and a diluting liquid source for providing diluting liquid to the solution in the collection zone. A thermal valve assembly can be operatively connected to the make-up liquid source to automatically introduce varying amounts of diluting liquid to the collection zone based upon the temperature of the liquid to adjust the flow rate of the liquid to control the concentration of the solution.

According to yet another aspect of the invention, an assembly for continuously adjusting the concentration of a solution formed by a liquid in contact with a concentrated product chemistry collected in a collection zone is provided. The assembly includes a diluting liquid source adjacent the collection zone. A thermal valve assembly is operatively connected to the diluting liquid source to automatically introduce a continuously variable amount of diluting liquid to the collection zone based upon the temperature of the liquid to adjust the flow rate of the liquid to control the concentration of the solution.

DETAILED DESCRIPTION OF THE PREFERRED EMBODIMENTS

Figure 1:
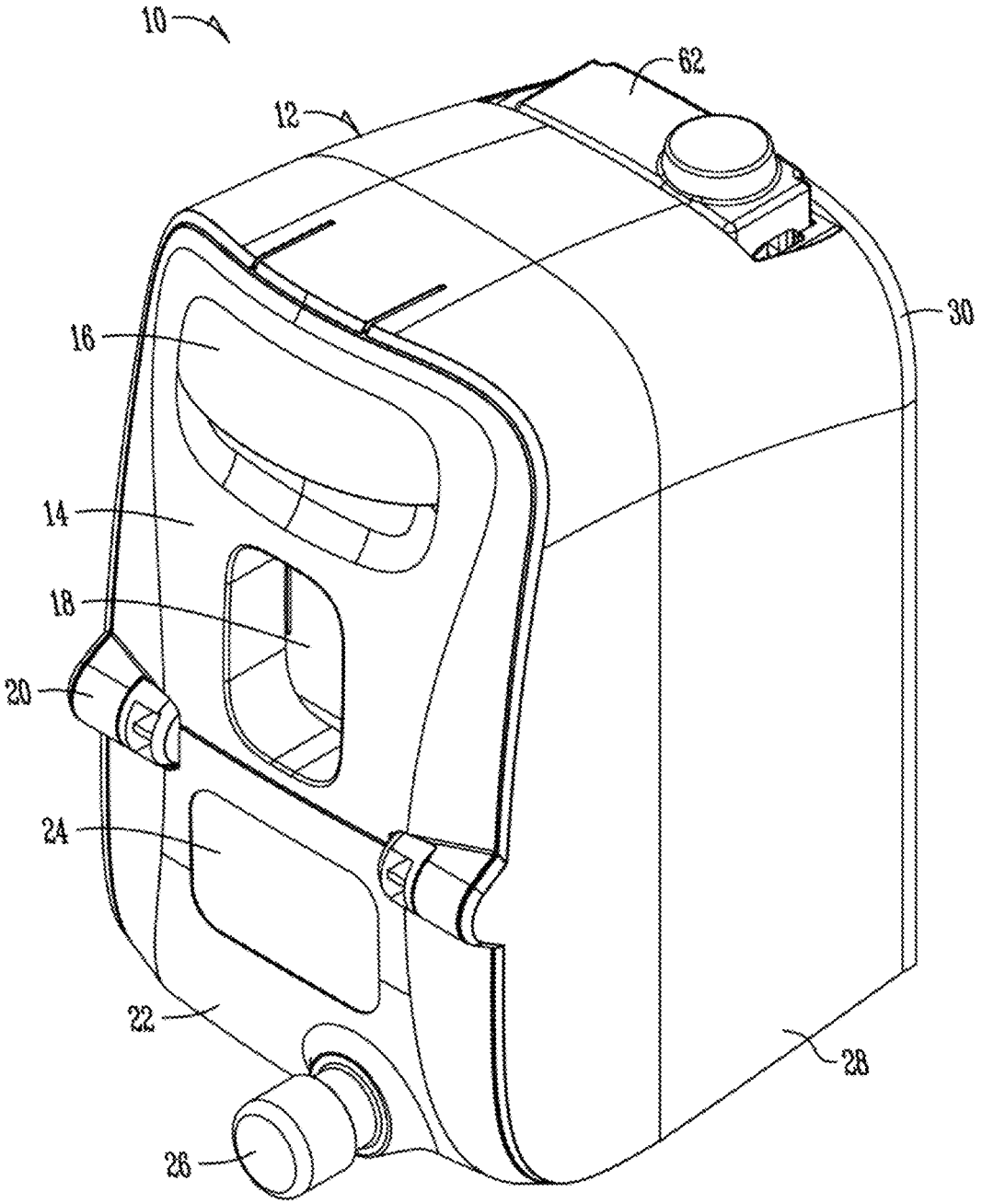
FIG. 1 is a perspective view of an embodiment of a dispenser.

FIG. 1 shows an exemplary embodiment of a dispenser 10 for use with the present invention. However, it should be noted that other types and configurations of dispensers may be used with the invention, and the description and figures of the dispenser 10 are not to be limiting. The dispenser 10 is configured to hold a concentrated product chemistry that is combined with a liquid, such as water, to create a solution, which may also be known as a product chemistry. For purposes of the present invention, the terms should be considered interchangeable. The concentrated product chemistry may be a solid, gel, powder, or other composition that can be mixed with a liquid, for example water, to form a solution. For example, a solid product chemistry may be mixed with the liquid to create a cleaning detergent. However, it should also be appreciated that the product could be mixed with any fluid, such as steam, air, or other gases that erode the product to create a usable chemistry. For example, the solid product could be eroded with a gas or other fluid to create a powder that is dispensed from the dispenser 10 to an end use, such as an appliance. In such a situation, the product could be a solid laundry detergent, which needs eroded to powder-like form to be added to a washing machine. The detergent could be eroded by a fluid, such as air or another gas, and the result could be then dispensed into the washing machine, where it will mix with water or other liquids, as is known, to create a liquid detergent for cleaning items.

According to some embodiments, the dispenser 10 works by having the liquid interact with the solid product to form a product chemistry having a desired concentration for its end use application. The liquid may be introduced to a bottom or other surface of the solid product, as will be discussed below. However, as mentioned, a problem can exist in obtaining and/or maintaining a desired concentration of the product chemistry.

Therefore, the dispenser 10 of the invention includes a novel flow control that is automatically adjustable based on an uncontrolled condition, such as the temperature of the fluid in contact with the solid product chemistry. The flow of a makeup, diluent, or similar fluid can be automatically adjusted to account for a change in the temperature of the fluid. For example, while it is contemplated that the added fluid, which may be known as the diluting fluid, is a compressible fluid, such as water, it should be appreciated that generally any compressible fluid, such as a compressed gas, could also be used to mix with the solution or product chemistry, based upon the temperature of the initial fluid that is used to erode or otherwise mix with a first chemistry.

The flow rate/scheme can be adjusted based upon known relationships between the temperature of the liquid and the dispense rate of the solid chemistry. For example, by understanding the rate change of product dispensed per change in degree of liquid temperature change, the flow rate of a liquid can be adjusted to counteract the temperature change. Put another way, the concentration can be adjusted according to known relationships between the erosion or dispense rate and the temperature of the liquid in contact therewith.

According to the exemplary embodiment, the dispenser 10 of FIG. 1 includes housing 12 comprising a front door 14 having a handle 16 thereon. The front door 14 is hingeably connected to a front fascia 22 via hinges 20 therebetween. This allows the front door 14 to be rotated about the hinge 20 to allow access into the housing 12 of the dispenser 10. For example, the front door 14 includes a window 18 therein to allow an operator to view the solid product housed within the housing 12. Once the housed product has been viewed to erode to a certain extent, the front door 14 can be opened via the handle to allow an operator to replace the solid product with a new un-eroded product.

The front fascia 22 may include a product ID window 24 for placing a product ID thereon. The product ID 24 allows an operator to quickly determine the type of product housed within the housing 12 such that replacement thereof is quick and efficient. The ID 24 may also include other information, such as health risks, manufacturing information, date of last replacement, or the like. Also mounted to the front fascia 22 is a button 26 for activating the dispenser 10. The button 26 may be a spring-loaded button such that pressing or depressing of the button activates the dispenser 10 to discharge an amount of solution created by the solid product and the liquid. Thus, the button 26 may be preprogrammed to dispense a desired amount per pressing of the button, or may continue to discharge an amount of solution while the button is depressed.

Connected to the front fascia 22 is a rear enclosure 28, which generally covers the top, sides, and rear of the dispenser 10. The rear enclosure 28 may also be removed to access the interior of the dispenser 10. A mounting plate 30 is positioned at the rear of the dispenser 10 and includes means for mounting the dispenser to a wall or other structure. For example, the dispenser 10 may be attached to a wall via screws, hooks, or other hanging means attached to the mounting plate 30.

The components of the housing 12 of the dispenser 10 may be molded plastic or other materials, and the window 18 may be a transparent plastic such as clarified polypropylene or the like. The handle 16 can be connected and disconnected from the front door 14. In addition, a backflow prevention device 62 may be positioned at or within the rear enclosure 28 to prevent backflow of the solution.

Figure 2:
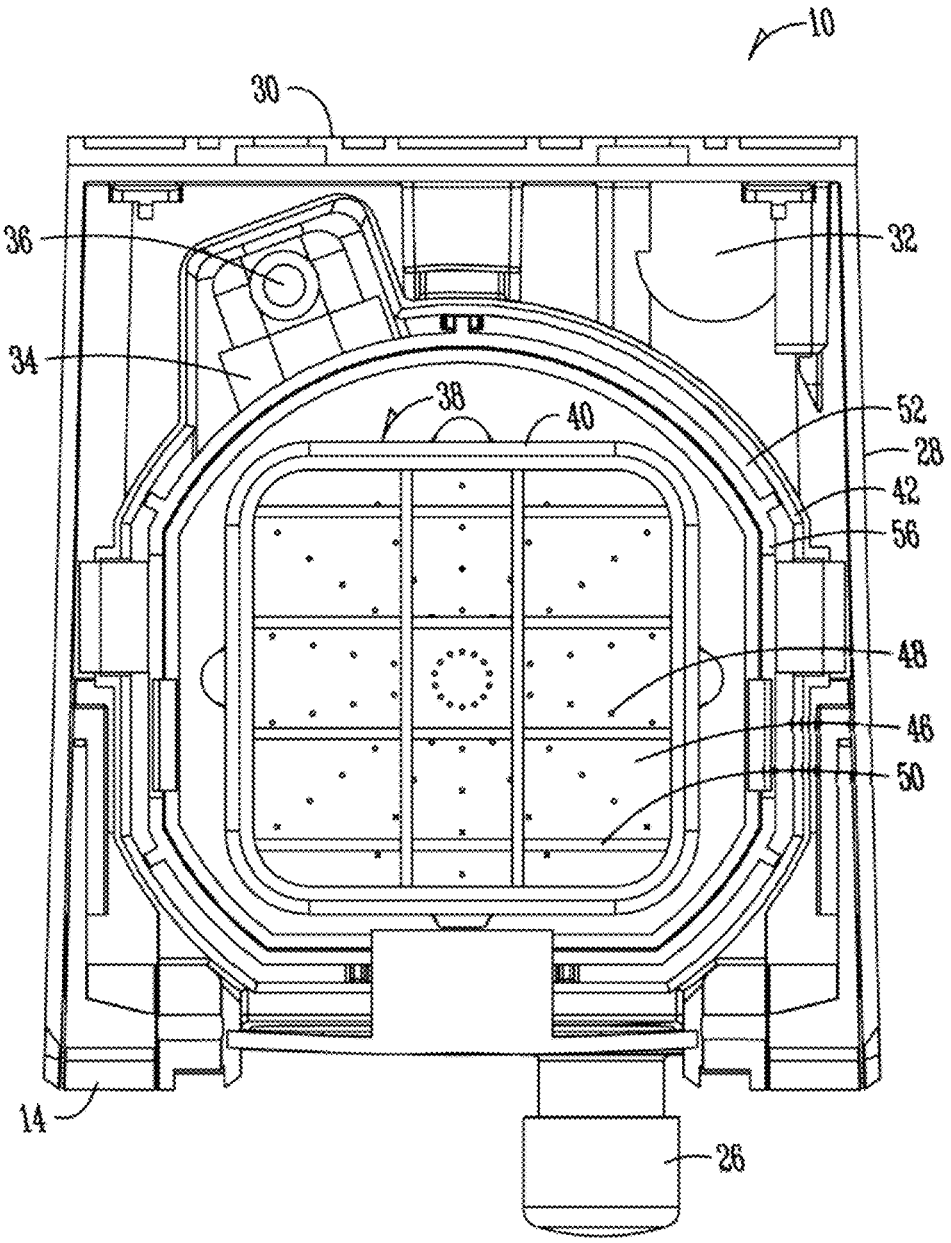
FIG. 2 is a top sectional view of the dispenser of FIG. 1.
Figure 3:
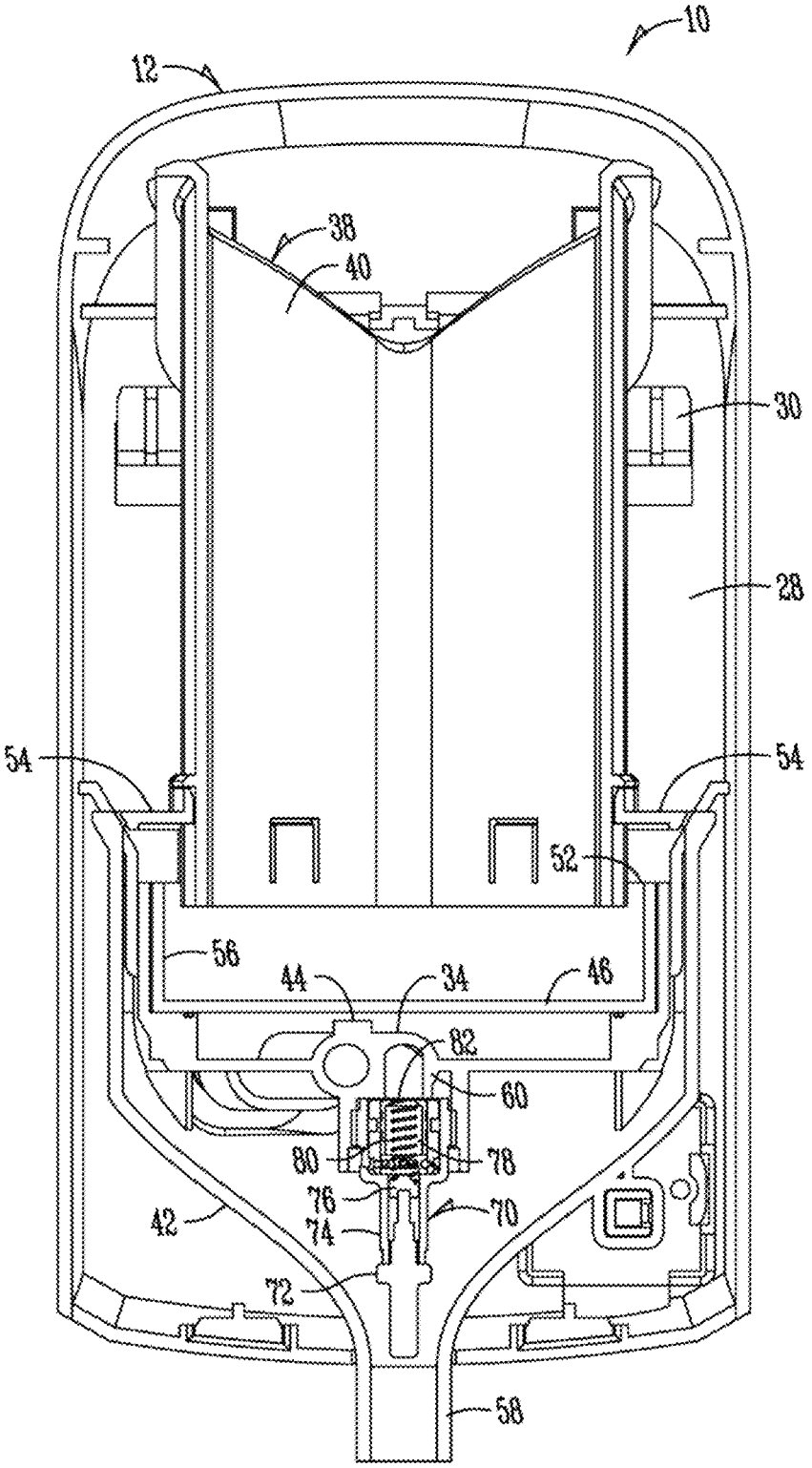
FIG. 3 is a front sectional view of the dispenser of FIG. 1.

FIGS. 2 and 3 are top and front sectional views of the dispenser 10 according to an embodiment of the invention. A solid product (not shown) is placed within a cavity 38, which is surrounded by walls 40. The solid product chemistry is placed on a support member 50, which is shown to be a product grate comprising interlocking wires. A liquid, such as water, is connected to the dispenser 10 via the liquid inlet 32 shown in FIG. 2 on the bottom side of the dispenser 10. The liquid is connected to the button 26 such that pressing the button will pass liquid into the dispenser 10 to come in contact with the solid product. The liquid is passed through a liquid source 34 via a fitment splitter 36. As shown, the liquid source 34 is a split, two-channeled liquid source for different flow paths. Each of the paths contains a flow control (not shown) to properly distribute liquid in the intended amounts. This flow control can be changed to alter the turbulence of the liquid coming in contact with the solid product to adjust the turbulence based on the characteristics to maintain the formed solution within an acceptable range of concentration. The liquid passes through the liquid source 34, through a backflow prevention device 62, and out the liquid source 44. The liquid source 44 is positioned adjacent a puck member 46, which may also be known as a manifold diffuse, such that the liquid passing through the liquid source 44 will be passed through puck ports 48 of the puck member 46.

The liquid will continue in a generally upwards orientation to come in contact with a portion or portions of the solid product supported by the product grate 50. The mixing of the liquid and the concentrated product, such as a solid product, will erode the solid product, which will dissolve portions of the solid product in the liquid to form a solution. This solution will be collected in the solution collector 56, which is generally a cup-shaped member having upstanding walls and bottom floor comprising the puck member 46. The solution will continue to rise in the solution collector 56 until it reaches the level of an overflow port 52, which is determined by the height of the wall comprising the solution collector 56. According to an aspect, the solution collector 56 is formed by the puck member 46 and walls extending upward therefrom. The height of the walls determines the location of the overflow port 52. The solution will escape, pass over, or pass through the overflow port 52 and into the collection zone 42, in this case a funnel. The liquid source 34 includes a second path, which ends with a makeup or diluting liquid source 60. Therefore, diluting liquid, which also be known as make-up liquid, may be added to the solution in the collection zone 42 to dilute the solution to obtain a solution having a concentration within the acceptable range.

Other components of the dispenser 10 include a splash guard 54 positioned generally around the top of the collection zone 42. The splash guard 54 prevents solution in the collection zone 42 from spilling outside the collection zone 42.

One way to control the concentration of the solution prior to discharging the solution via the outlet 58 is to add additional liquid in the form of a makeup and/or diluting liquid through the makeup source 60. The flow rate for the diluting liquid can be controlled via a flow control within the liquid source 34 and/or fitment splitter 36. In addition, a thermal valve assembly 70 can be added adjacent the makeup or diluting source 60 to provide further controls for adding the diluting liquid based upon the temperature of the liquid in contact with the solid product.

As is known, the temperature of the liquid contacting the solid product will have a direct relationship on the erosion rate of the solid product, i.e., the higher the temperature, the higher the erosion rate of the solid product. This can create the issue of forming a solution having a higher concentration than that desired. The solution collected in the collection zone 42 may be outside an acceptable range of concentration. The diluting liquid dispensed from the diluting source 60 can dilute this solution prior to discharge by varying the amount of flow of the liquid via the thermal valve assembly 70.

Figure 4:
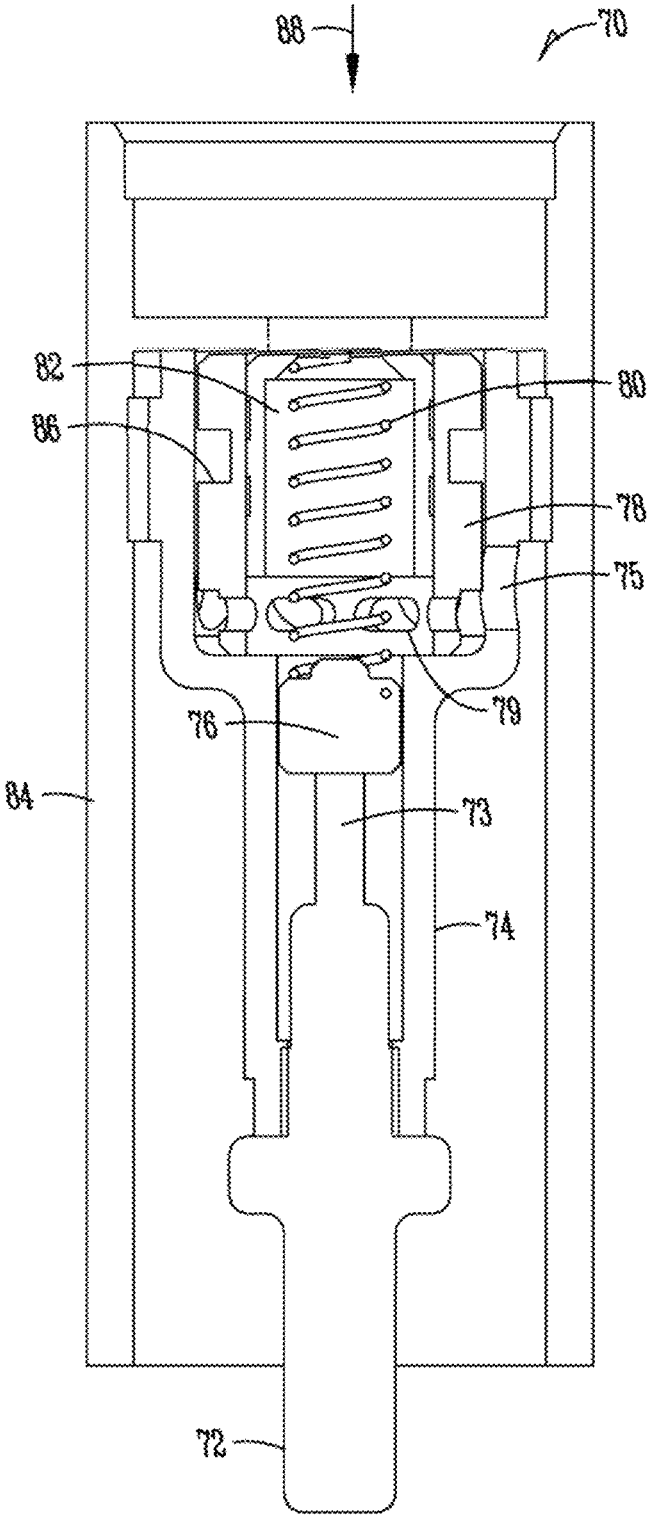
FIG. 4 is a front sectional view of a thermal valve assembly according to an embodiment of the invention.

An embodiment of the thermal valve assembly 70 is shown in FIGS. 3 and 4. The assembly 70 includes a temperature dependent device, in this case a thermal actuator 72, which also may be known as a thermal motor. The present application contemplates that the thermal actuator 72 may be purchased as part no. 0450050 from Watts Regulator Company, 815 Chestnut Street, North Andover, Mass. 01845. However, it should be appreciated that other part numbers and manufacturers may provide thermal actuators capable of performing the steps of the present invention. The thermal actuator includes a phase change media, such as wax. As the temperature rises, the phase change media within the thermal actuator melts or otherwise changes phase, which can extend a thermal shaft 73 therefrom. The phase change media within the thermal actuator 72 can be configured such that the extension of the thermal shaft 73 from the actuator 72 may occur within a preset or desired temperature range. In addition, as the temperature of the phase change media within the thermal actuator 72 is reduced, the shaft will retract to within the actuator body.

The thermal actuator 72 shown in FIGS. 3 and 4 is connected to a pressure body 74 having a plurality of apertures 75. The pressure body 74 at least partially surrounds the thermal actuator 72, including the thermal shaft 73. Connected to the shaft 73 is a spring piston 76 positioned adjacent a spring 80. In other embodiments, the spring piston 76 comprises part of the shaft 73. The spring 80 is at least partially surrounded by a piston sleeve 78. The piston sleeve 78 includes a plurality of sleeve apertures 79. Also included opposite the spring piston 76 is a pressure piston 82 adjacent to and at least partially surrounding the spring 80. Additional components may be O-rings 86 positioned around the piston sleeve 78, as well as a splash shield 84 at least partially surrounding the other components of the valve assembly 70.

The thermal valve assembly 70 shown in FIGS. 3 and 4 provides a continuously variable, automatic adjustment to the flow rate of the makeup or diluting water through the diluting source 60. The thermal valve assembly 70 will provide an ever-changing amount of liquid to pass therethrough and into the solution in the collection zone 42 to aid in controlling the concentration of the formed solution. The makeup or diluting liquid would flow in the direction shown by the arrow 88 in FIG. 4. The liquid is able to pass through apertures of the components of the thermal valve assembly 70 such that an amount of water passes through the bottom of the splash shield 84 and into the collection zone 42 of the dispenser 10. However, if the temperature of the liquid passing through the thermal valve assembly 70 begins to rise, the phase change media within the thermal actuator 72 will begin to melt. The melting of the phase change media will cause the thermal shaft 73 to begin to extend based upon the amount of change in temperature. It should be noted that this extension could be linearly related to the rise in temperature of the liquid such that a slight range in temperature will only slightly extend the thermal shaft 73, while a large increase in temperature will cause the thermal shaft 73 to extend farther from the thermal actuator 72.

However, this provides one advantage of the present invention in that the extension shaft 73 is a linear response to temperature, and is not a stepped response. Therefore, there will be a continuously variable extension. The continuously variable extension of the shaft 73 will provide a continuously variable flow rate through the thermal valve assembly 70 to continuously change the flow rate of the diluting liquid being dispensed into the collection zone 42 to adjust the concentration of the solution formed therein.

The thermal valve assembly 70 shown in FIG. 4 also is independent of the pressure of the liquid flowing in the direction of the arrow 88 shown in FIG. 4. While the thermal valve assembly 70 will be automatically adjusted based on the temperature of the liquid, the pressure of the liquid will not affect the amount of liquid therethrough. For example, as the liquid flows in the direction shown by the arrow 88 in FIG. 4, normally, the components can be displaced due to the pressure of the liquid. However, as the thermal valve assembly 70 includes a piston 82 adjacent the upper end of the spring 80, this will account for the added pressure of the liquid, and will ensure that no additional liquid is passed through the assembly due to a pressure increase. Thus, as the pressure of the liquid increases, it will displace the piston 82 in a downward manner. This will cause the spring 80 to compress. However, the compression of the piston 82 will close off the radial sleeve apertures 79, which will counteract the effect of the change in pressure. With different temperatures, the thermal actuator 72 will increase and decrease the length of the thermal shaft, moving the piston 82. Changing the location of the spring piston 76 will change the pre-load that is set on the spring 80. The balance between the water pressure force 88 and the spring 80 force will dictate where the piston is relative to the radial holes on the sleeve. This will ensure the same amount of liquid will be passed even though there has been a change in pressure.

Thus, the thermal valve assembly 70 shown in FIGS. 3 and 4 provides a continuously variable, pressure independent, automatic flow rate adjustment for the diluting liquid passing from the diluting liquid source 60 into the formed solution in the collection zone 42. As discussed, as the temperature of the liquid rises, the thermal actuator 72 will cause the shaft 73 to extend. This in turn will cause the spring piston 76 to be displaced the same amount as the extension of the shaft 73. The displacement of the spring piston 76 will cause the spring to compress, which will allow for more liquid to pass through the thermal valve assembly 70 and into the collection zone 42, thus diluting the concentration of the liquid stored therein. Once the temperature begins to drop, the shaft 73 will be retracted back into the thermal actuator 72, and the spring piston 76 and spring 80 will be displaced to reduce the amount or the flow rate of the liquid passing therethrough. In addition, as noted, the amount of liquid or the flow rate of the liquid passing through the thermal valve assembly 70 will not be dependent upon a change in the pressure of the liquid in the direction of the arrow 88 of FIG. 4.

Figure 5:
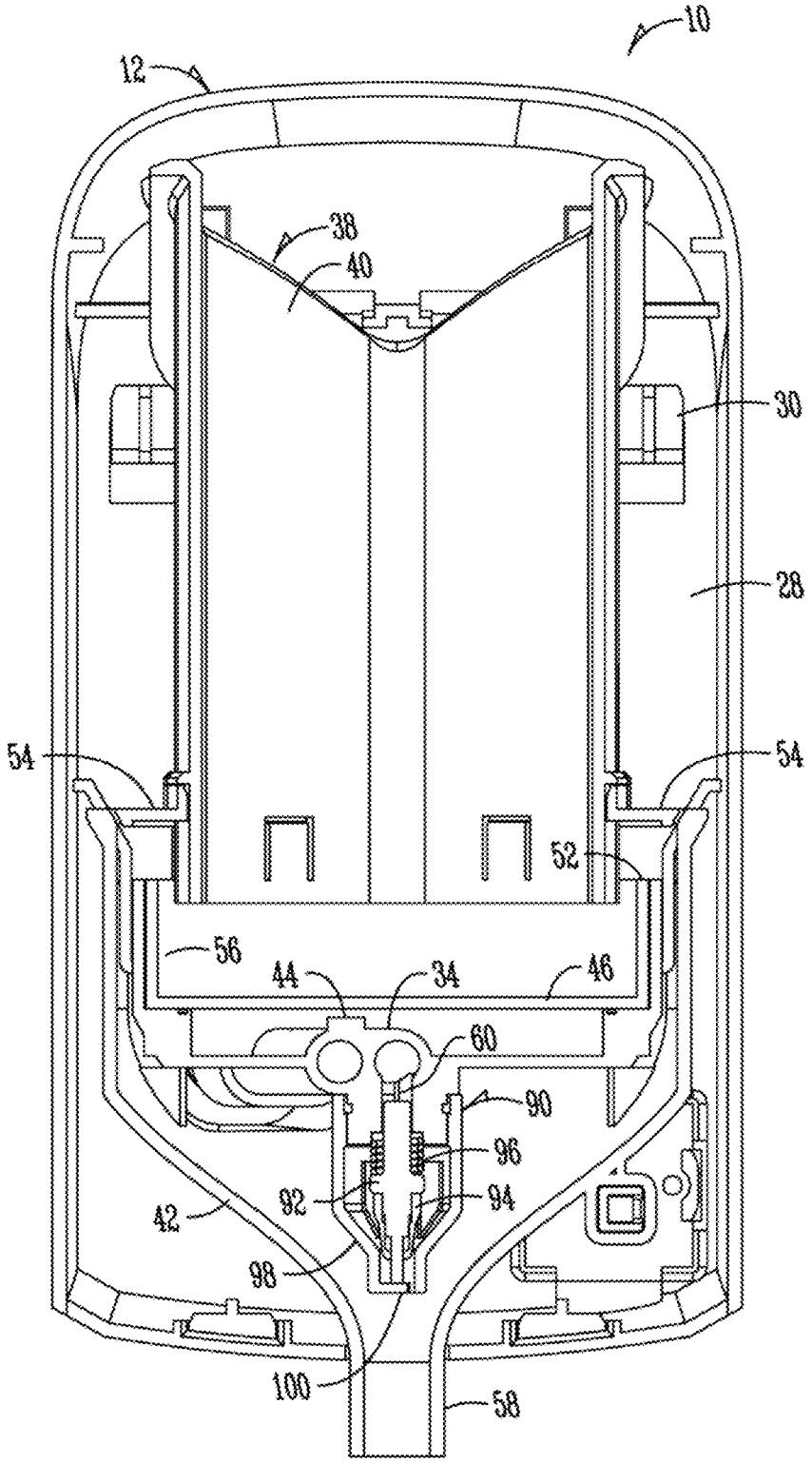
FIG. 5 is a front sectional view of another embodiment of a dispenser.
Figure 6:
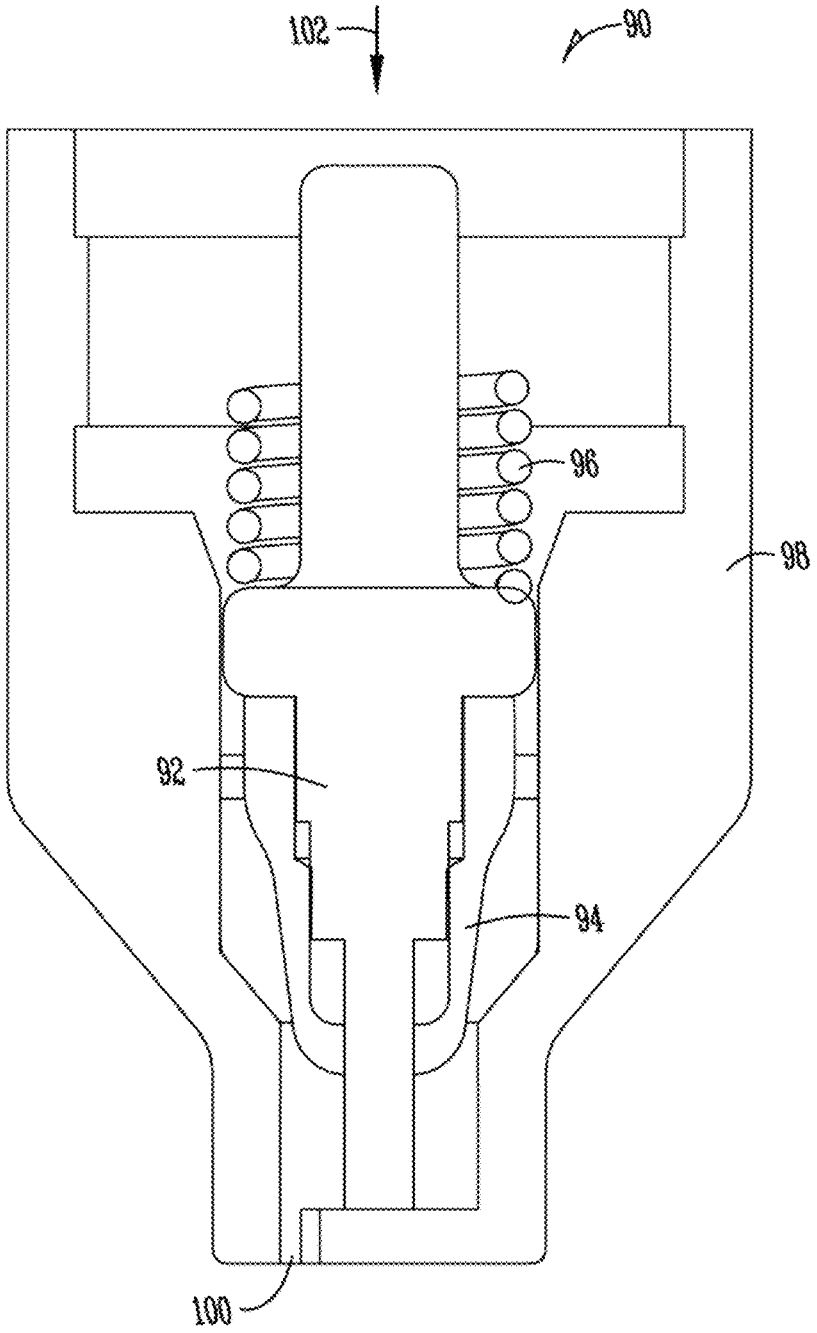
FIG. 6 is a front sectional view of an embodiment of a thermal valve assembly used with the dispenser of FIG. 5.

FIGS. 5 and 6 show another embodiment of the dispenser 10 of the present invention including a space needle type thermal valve assembly 90 operatively connected to the makeup source 60 and positioned to allow diluting or makeup liquid to pass into the collection zone 42. The thermal valve assembly 90 shown in FIGS. 5 and 6 are also dependent upon the temperature of the liquid passing therethrough. The assembly 90 includes a thermal actuator 92, which may be the same or similar thermal actuator as discussed in relation to FIGS. 3 and 4 above. The assembly 90 further includes a needle 94 operatively connected to the thermal actuator and moveable with the shaft of the actuator. The needle at least partially surrounds the shaft of the thermal actuator 92 of the valve assembly 90.

Also included in the thermal valve assembly 90 is a spring 96 and needle body 98. The needle body 98 at least partially surrounds the components of the assembly 90 and includes an aperture 100 at a lower end of the body 98. As shown in FIG. 6, the makeup liquid flows generally in the direction shown by the arrow 102. The flow is able to pass through the needle body 98 and out the aperture 100 thereof. However, as the temperature of the liquid changes, the flow rate or the amount of liquid passing through the assembly 90 may need to be varied to account for a higher or lower concentration of solution in the collection zone 42. Thus, the assembly 90 provides for a continuously variable amount of liquid to pass therethrough and into the collection zone 42.

Similar to the assembly 70 above, the actuator 92 of the assembly 90 will extend and retract due to a change in the temperature of the liquid in contact with the actuator. However, in this embodiment, the end of the shaft of the actuator 92 is generally positioned at the end of the needle body 98 having one or more apertures 100 therethrough. Thus, as the shaft of the actuator extends, the aperture body will actually move in an upwards direction to compress the spring 96. This upwards movement of the actuator will cause the needle 94 to move in an upwards manner as well, which will unplug or widen the amount of space at the lower end of the body 98 such that more liquid will be passed through the body 98 and into the collection zone 42. As the temperature of the liquid is lowered, the shaft will retract into the thermal actuator 92, which will cause the actuator to move in a downward direction, thus uncompressing the spring and providing for the needle 94 to plug more area through the body 98 of the assembly 90.

As mentioned above, the actuator 92 shown in FIGS. 5 and 6 responds linearly to a change in temperature. Thus, a slight change in temperature will cause the shaft to extend in a short distance, which will allow a slightly more amount of liquid to flow therethrough. As the temperature rises, the shaft extends further, which will in turn allow more liquid to pass therethrough. Therefore, the assembly 90 will provide an automatic, continuously variable amount of liquid to be added to the solution in the collection zone 42 such that the concentration thereof can be control.

The thermal valve assemblies shown in FIGS. 3-6 include numerous advantages. For example, there are fewer parts integrated into the same assembly, which will reduce the cost of the thermal valve assembly. In addition, the flow is a linear response to temperature, as opposed to a stepped response. Thus, the amount of the liquid passing through the assembly will be continuously variable in a linear manner to account for change in temperature of the liquid. Furthermore, the flow rate can be independent of pressure, as described above. The thermal valve assembly is also smaller than previous methods of providing diluting liquid to the collection zone 42, such that the assembly can be incorporated into empty space in the middle of the collection zone 42.

It should be appreciated that the change in temperature of a liquid does not always equate to a linear change in the erosion rate of the solid product chemistry in contact with the liquid, and therefore, the thermal valve assemblies of the invention can be manipulated accordingly. For example, with some chemistries, there will be an exponential relationship between the temperature of a liquid and the erosion rate, and thus, concentration, of the product. Therefore, the thermal valve assemblies of the invention can be set up such that they will allow an exponentially higher amount of diluting liquid to be mixed with a combination of the first liquid and the product to account for the higher temperatures. Furthermore, it should be appreciated that some chemistries may erode faster with cooler temperatures, and thus, the thermal valves of the invention can be set such that they will allow more water to pass when there is a drop in the temperature, as opposed to an increase in the temperature.

FIGS. 7-10 show yet another embodiment of a thermal valve assembly 110 for use with a dispenser 10 according to aspects of the present invention. The thermal valve assembly 110 shown in FIG. 7-10 is similar to the assemblies shown in FIGS. 4 and 6. The assembly 110 includes a body 112, which can be connected to a dispenser 10, such as to a puck enclosure 64, which is shown best in FIG. 10. The thermal valve assembly 110 can be attached to the enclosure 64 by any attachment means, such as bolts, screws, pins, adhesives, or the like.

Positioned generally adjacent the diluting liquid source 60 is one end of the thermal valve body 112, which can include a piston-retaining clip and washer 114. A sleeve 116 is positioned adjacent the washer 114, and includes a piston 118 and spring 120 within the sleeve 116. The spring 120 may be preloaded, but can be compressed to allow movement of the piston 118 within the sleeve 116. It is noted that the sleeve includes a plurality of apertures 117, which may take generally any size, configuration, pattern, etc.

Figure 7:
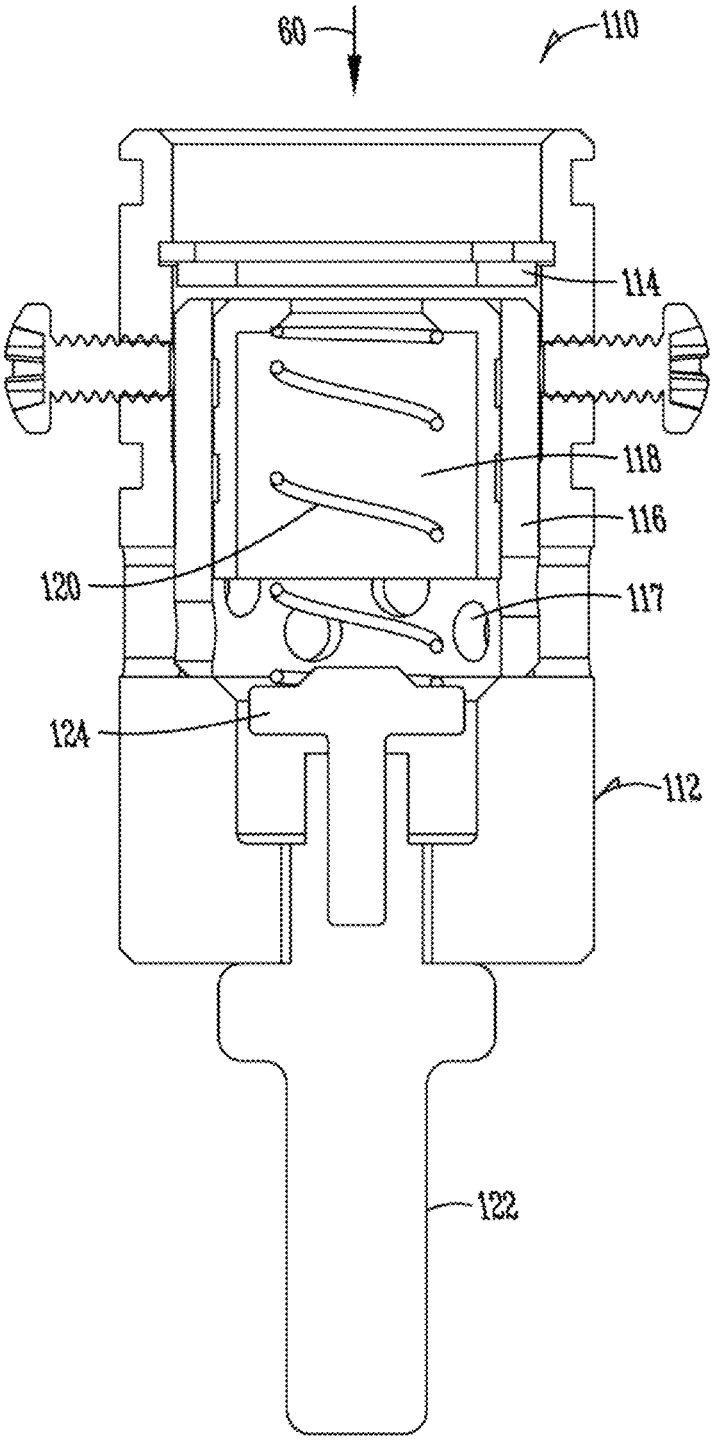
FIG. 7 is a front sectional view of another thermal valve assembly for use with a dispenser according to the invention.
Figure 8:
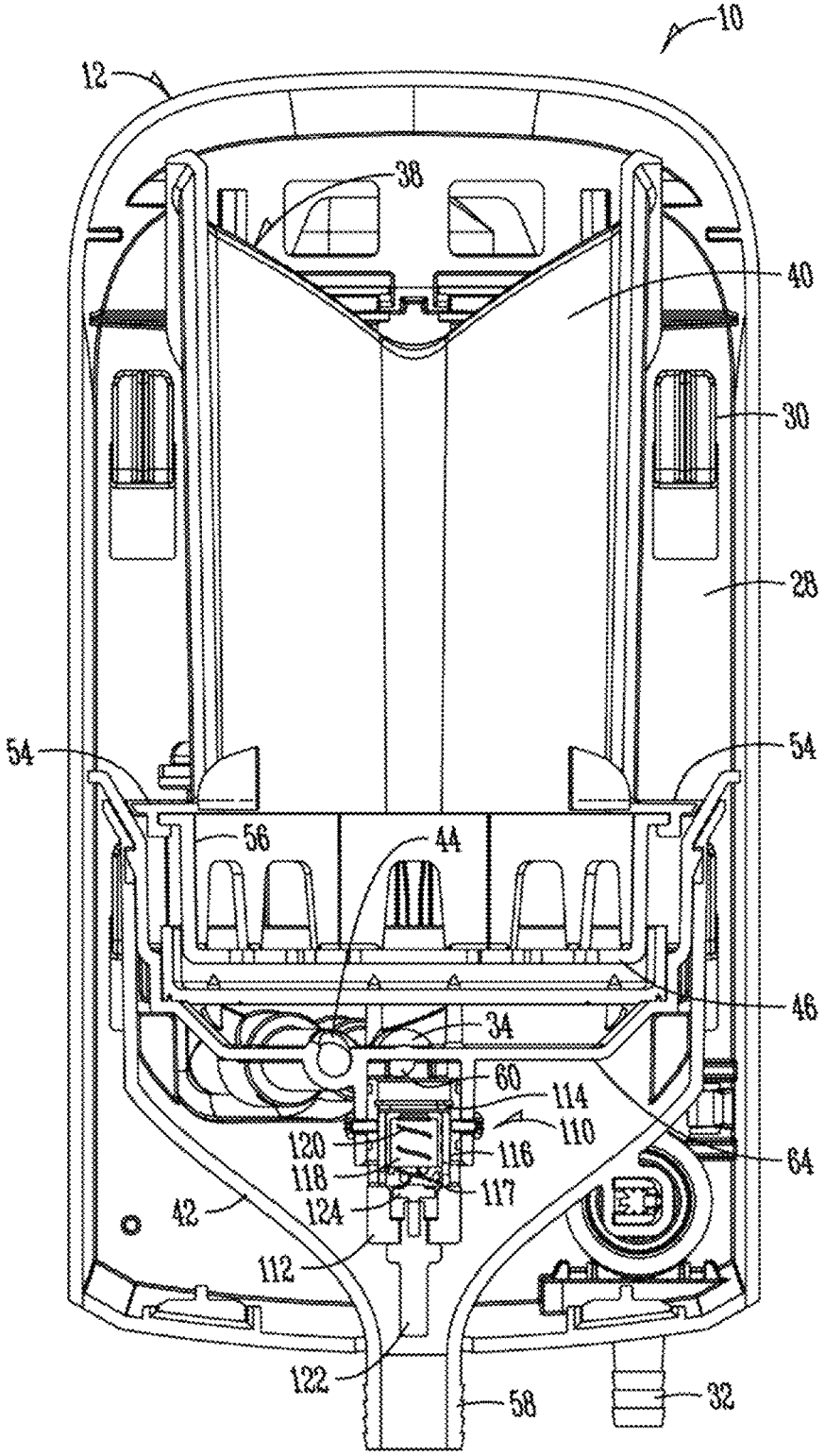
FIG. 8 is a front sectional view of the dispenser with the thermal valve assembly of FIG. 7 positioned therein.
Figure 9:
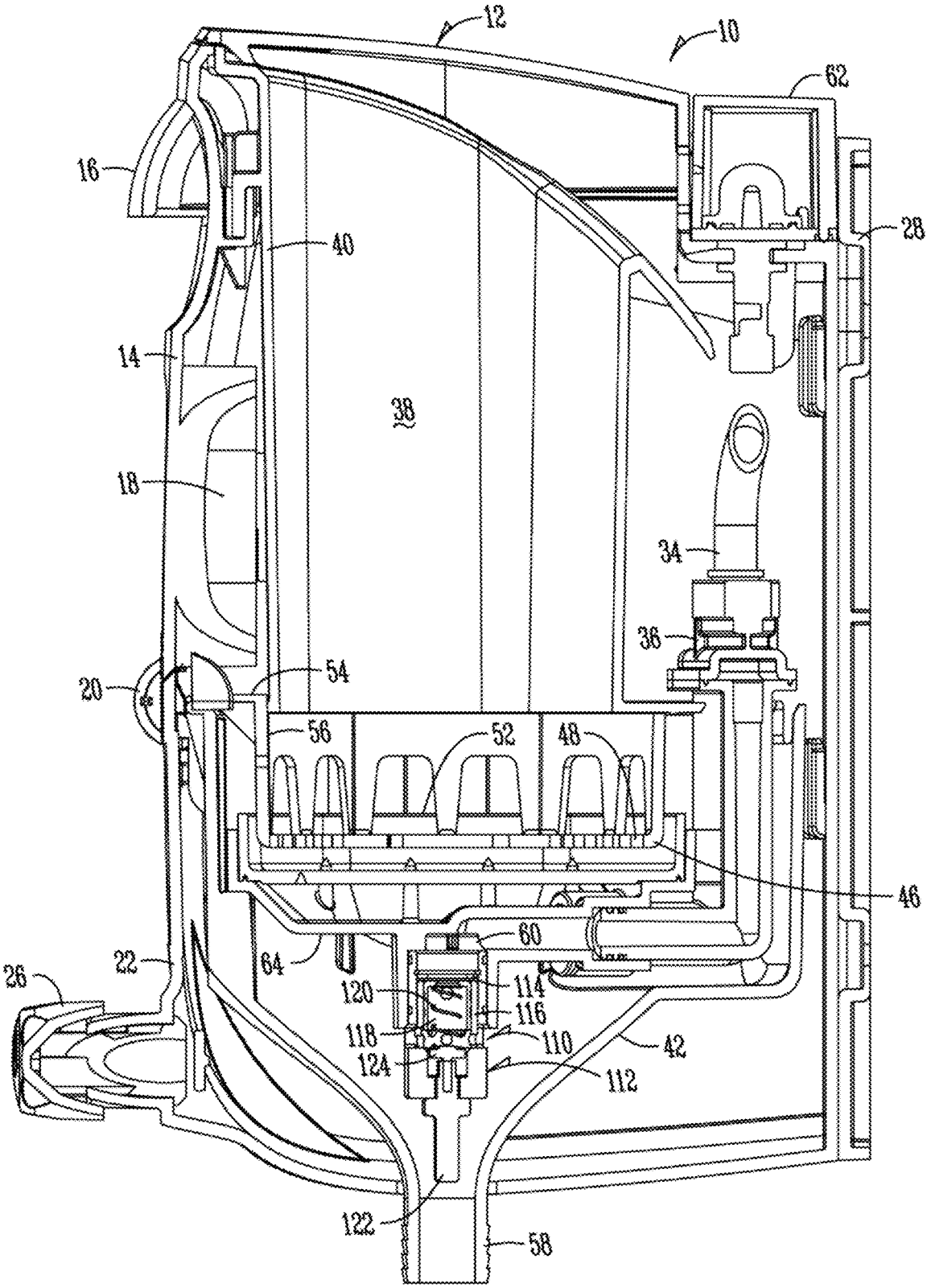
FIG. 9 is a side sectional view of the dispenser of FIG. 8.
Figure 10:
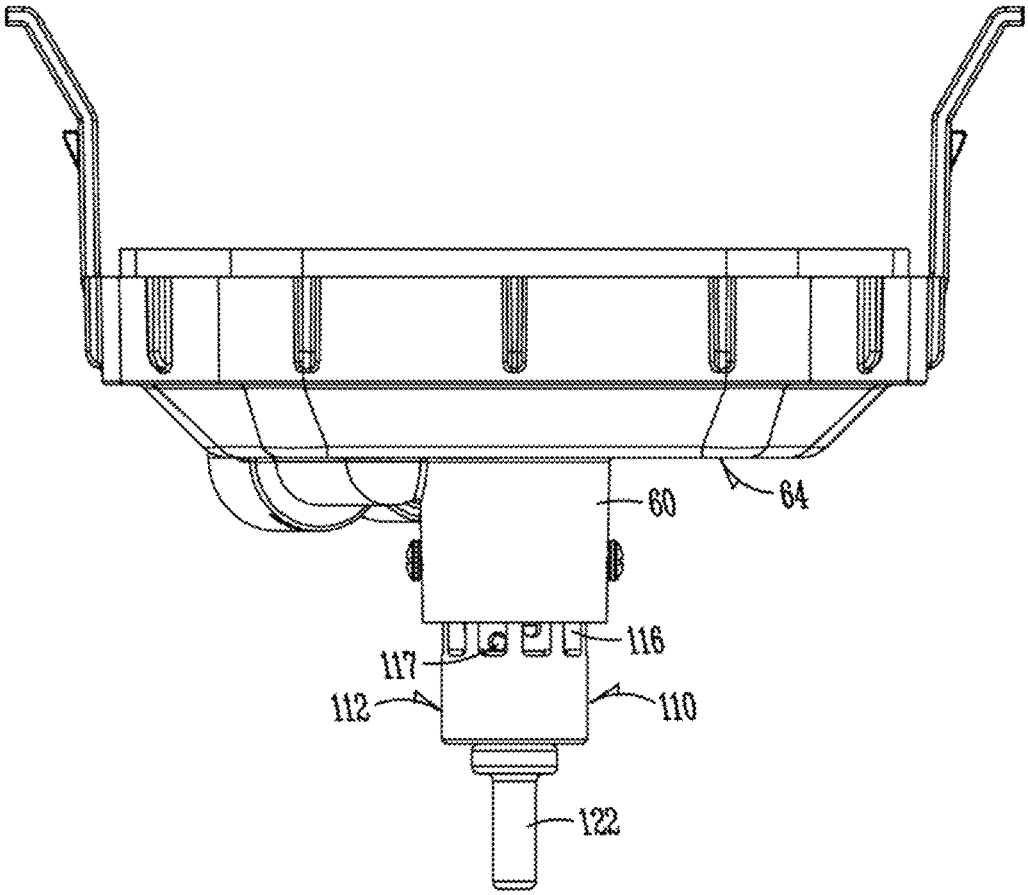
FIG. 10 is a view of the thermal valve assembly of FIG. 7 attached to a portion of the dispenser.

Furthermore, a thermal actuator 122 and thermal piston 124 are operatively connected to the body 112 generally opposite the diluting liquid source. The thermal valve 122 is configured to extend the thermal piston 124 in an generally upward manner when introduced to temperatures upon a preset threshold for the actuator 122. This extension will move the piston 118 upwards, which will expose more of the apertures 117 of the sleeve, which will in turn allow for more liquid to pass through the assembly 110. The thermal valve shown in FIG. 7 is shown in an open position, with many of the apertures 117 uncovered by the piston 118. Generally, this is the configuration when a higher temperature liquid is used to erode the solid product of the dispenser, which may cause faster erosion. In such a case, allowing more liquid to pass through the thermal valve assembly 110 will allow more liquid to mix with a possible higher concentrated solution, to obtain and maintain a desired concentration of product chemistry prior to dispensement from the dispenser 10.

In addition, the thermal valve assembly 110 shown in FIGS. 7-10 is pressure independent. For example, the pressure of the liquid entering the assembly 110 from the source 60 will not affect the amount of liquid passing therethrough. As mentioned, the spring 120 is preloaded to exert a force on the piston 118. The spring 120, which may be a compression spring, can be selected such that a change in the pressure of the liquid from the diluting liquid source 60 will not cause the spring to compress when the thermal piston 124 is not acting on the piston 118. This will hold the piston 118 in place, and will not cause the piston 118 to block or open more sleeve apertures 117 than has been set by the thermal piston 124 of the thermal actuator 122. As these are solely dependent on the temperature of the liquid passing through the assembly 110, they can be set and/or selected to provide for an amount of liquid to pass through the sleeve apertures 117 to account for the erosion rate of the temperature of the fluid in contact with the product.

When a cooler temperature of the liquid from the liquid source 60 is introduced to the thermal assembly 110, the thermal piston 124 can retract into the thermal actuator 122, which will move the piston 118 to block more of the sleeve apertures 117, which will allow less liquid to pass through the assembly 110.

It is known that one of the benefits of the present invention is to provide for greater control of the concentration of the solution form between a liquid in contact with a solid product chemistry. The control of the concentration will provide for greater safety for operators of the dispenser as the concentration should be constricted within an acceptable range of use for the solution. In addition, the control of the concentration should also provide economic benefits as the concentration of the solution can be maintained in an acceptable range, the amount of solid product chemistry used can be controlled as well. This will provide benefits such as being able to know when or approximately when a new solid product chemistry will need to be replaced in the dispenser, which will allow a business to plan ahead and purchase an appropriate number of solid product chemistries for a period of time, such as a fiscal year. The control of the amount of makeup or diluting liquid into the collection zone to control the concentration of the solution therein will also provide safe handling characteristics of the solution.

The use of the thermal valves with the dispensers, as has been shown and described, can also be useful for terms of monitoring the dispensing system. For example, the thermal valves, or components thereof, could be connected to a thermostat, sensor, or other mechanism, which can be operatively connected (either wired or wirelessly) to an alert system, such as a visual, audio, or combination alarm. The monitoring system can provide an alert such that the alarm will provide notification when there has been a prolonged change, sudden change, etc. The alarm can be seen, heard, or otherwise transmitted, such as by haptic alerts, by a technician, who will know to check on the dispensing system.

The foregoing description has been presented for purposes of illustration and description, and is not intended to be an exhaustive list or to limit the invention to the precise forms disclosed. It is contemplated that other alternative processes obvious to those skilled in the art are to be considered in the invention. For example, the invention also contemplates that the change in temperature may be inverse to the amount of diluting liquid added to the collection zone. Depending on the composition of the concentrated product, a decrease in liquid temperature may require more diluting liquid added to the collection zone than when the temperature is higher. In such cases, the assemblies of the present invention can be adjusted to allow for more diluting liquid to be added upon a decrease in the temperature of the liquid.

It is to be understood that the present invention provides the advantage being able to provide an automatic and continuously variable control for the concentration of a solution or in between a liquid and a solid product chemistry and to maintain a solution having a concentration within an acceptable range.

What is claimed is:

1. A dispenser for obtaining a solution from a diluting product chemistry and a liquid, comprising:

a housing;

a cavity at least partially within the housing for holding the diluting product chemistry;

a liquid source for providing the liquid to contact the diluting product chemistry to form the solution;

a collection zone operatively connected to the housing to collect the formed solution;

a diluting liquid source for providing diluting liquid to the solution in the collection zone; and a thermal valve assembly operatively connected to the diluting liquid source to automatically introduce varying amounts of diluting liquid to the collection zone based upon the temperature of the liquid to adjust the flow rate of the liquid to control the concentration of the solution;

said thermal valve assembly comprising a thermal actuator having a thermal shaft extendable therefrom wherein extension of the thermal shaft is linearly related to the temperature of the liquid such that there is continuously variable extension;

wherein the thermal valve assembly further comprises a spring operatively connected to the thermal shaft, a spring piston operatively connected to and/or comprising part of the thermal shaft and positioned adjacent to the spring, and a pressure piston positioned adjacent to the spring opposite the spring piston.

2. The dispenser of claim 1, further comprising an outlet operatively connected to the cavity to dispense the solution from the dispenser.

3. The dispenser of claim 1, wherein the thermal valve assembly provides a continuously variable amount of diluting liquid to the collection zone.

4. The dispenser of claim 1, wherein the thermal valve assembly further comprises:

a sleeve operatively connected to the spring.

5. The dispenser of claim 4, wherein the spring piston is adjusted by the extending of the shaft to allow a continuously variable amount of diluting liquid through the thermal valve assembly.

6. The dispenser of claim 5, wherein the shaft is extended as the temperature of the liquid increases, and is retracted as the temperature decreases.

7. The dispenser of claim 6, wherein the thermal valve assembly further comprises a thermal valve body at least partially surrounding the thermal actuator, spring, spring piston, and sleeve.

8. The dispenser of claim 7, wherein the thermal valve assembly further comprises a splash shield at least partially surrounding the thermal valve body.

9. The dispenser of claim 1, wherein the diluting liquid is introduced to obtain and maintain the concentration of the solution.

10. The dispenser of claim 1, wherein the thermal valve assembly further comprises a phase change media within a thermal actuator.

11. An assembly for continuously adjusting the concentration of a solution formed by a liquid in contact with a concentrated product chemistry collected in a collection zone, comprising:

a diluting liquid source adjacent the collection zone; and a thermal valve assembly operatively connected to the diluting liquid source to automatically introduce a continuously variable amount of diluting liquid to the collection zone based upon the temperature of the liquid to adjust the flow rate of the liquid to control the concentration of the solution;

said thermal valve assembly comprising a thermal actuator having a thermal shaft extendable therefrom wherein extension of the thermal shaft is linearly related to the temperature of the liquid such that there is continuously variable extensions;

wherein the thermal valve assembly further comprises a spring operatively connected to the thermal shaft, a spring piston operatively connected to and/or comprising part of the thermal shaft and positioned adjacent to the spring, and a pressure piston positioned adjacent to the spring opposite the spring piston.

12. The assembly of claim 11, wherein the thermal valve assembly further comprises:

a sleeve that at least partially surrounds the spring.

13. The assembly of claim 12, wherein the spring piston is adjusted by the extending of the shaft to allow a continuously variable amount of diluting liquid through the thermal valve assembly.

14. The assembly of claim 12, wherein the thermal valve assembly further comprises a thermal valve body at least partially surrounding the thermal actuator, spring, spring piston, and sleeve.

15. The assembly of claim 12, further comprising a phase change media at least partially within the thermal actuator.

16. The assembly of claim 15, wherein a melting of the phase change media causes the thermal shaft to extend.

17. The assembly of claim 11, wherein the diluting liquid is introduced to obtain and maintain the concentration of the solution.

* * * * *